US006000090A

United States Patent [19]

Sutherland

[11] Patent Number: 6,000,090

[45] Date of Patent: Dec. 14, 1999

[54] PAINT ROLLER CONSTRUCTION HAVING TWO DEGREES OF FREEDOM

[76] Inventor: Daniel A. Sutherland, 9847 Seminole Blvd. #14, Seminole, Fla. 33772

[21] Appl. No.: 09/075,709

[22] Filed: May 11, 1998

[51] Int. Cl.[6] ..... B05C 17/00; B05C 17/02

[52] U.S. Cl. ..... 15/230.11; 15/150; 15/230

[58] Field of Search ..... 15/230.11, 230.14, 15/230, 150; 492/13, 17, 19, 24, 29

[56] References Cited

U.S. PATENT DOCUMENTS

| | | | |
|---|---|---|---|
| 2,187,585 | 1/1940 | Grigas . | |
| 2,813,292 | 11/1957 | McLendon . | |
| 3,130,435 | 4/1964 | Smith . | |
| 3,649,986 | 3/1972 | Dahlund . | |
| 4,000,537 | 1/1977 | Woo . | |
| 4,320,553 | 3/1982 | Charles . | |
| 4,335,484 | 6/1982 | Ridge et al. . | |
| 5,035,022 | 7/1991 | Iuliano et al. . | |
| 5,901,402 | 5/1999 | Williams | 15/144.1 |

*Primary Examiner*—Terrence R. Till
*Assistant Examiner*—Jennifer McNeil
*Attorney, Agent, or Firm*—Ronald E. Smith

[57] ABSTRACT

A pair of paint rollers are respectively rotatably mounted to a pair of parallel, spaced apart axle members that form a part of a rigid frame. A rigid clip rod at the center of the frame is releasably engaged by a clip member that is pivotally secured to a handle-receiving socket member at the leading end of an elongate handle which is held by a painter when paint is applied to a preselected surface. The pivotal attachment allows pivotal movement between the clip member and hence the frame and the longitudinal axis of the elongate handle in a first plane. The clip rod is cylindrical and is captured by the clip member when the clip member is in a position of repose, but the cylindrical surface allows the frame member to pivot with respect to the clip member and hence the elongate handle in a second plane that is normal to the first plane. A lock member is slideably mounted on the leading end of the socket member. It does not interfere with the pivotal movement in the first plane when in a retracted position, but it disable the pivotal movement in the first plane when in an extended position.

5 Claims, 3 Drawing Sheets

PAINT ROLLER CONSTRUCTION HAVING TWO DEGREES OF FREEDOM

BACKGROUND OF THE INVENTION

1. Field of the Invention

This invention relates, generally, to devices that apply paint to preselected surfaces. More particularly, it relates to a paint roller construction having two parallel rollers that are mounted to an elongate handle for pivotal movement in two planes.

2. Description of the Prior Art

Paint rollers are more efficient at delivering paint to a paintable surface than paint brushes, but conventional paint rollers are subject to an important drawback that renders them unsuitable for use in some applications.

Specifically, corners and certain hard-to-reach surfaces such as areas around doors, windows, fireplaces, and the like are often difficult to paint when using a conventional roller. Moreover, structures such as cathedral ceilings or other surfaces that include unusual angles are also difficult to paint with conventional rollers. As a result, many painters use rollers for large surfaces lacking obstructions and angles but revert to brushes when it is necessary to apply paint in a corner, on surfaces that meet at an angle other than ninety degrees, or around an obstruction. This is unacceptable, because it requires a painter to take both rollers and brushes to a job. Moreover, the use of brushes slows down the job and such use should therefor be minimized.

What is needed, then, is a paint roller construction that can be precisely maneuvered into corners or other angled surfaces and around windows and other obstructions.

However, in view of the art considered as a whole at the time the present invention was made, it was not obvious to those of ordinary skill in this art how the needed improvements could be provided.

SUMMARY OF THE INVENTION

The long-standing but heretofore unfulfilled need for an apparatus that overcomes the limitations of the prior art is now met by a new, useful, and nonobvious invention. The present invention is embodied in the form of a novel device for applying paint to a preselected surface. It includes a frame means that includes a first and a second axle means. Each of the first and second axle means are adapted to rotatably mount a paint roller thereon, and are disposed in spaced apart, parallel relation to one another. An elongate handle which is adapted to be grasped by an individual when applying paint to the preselected surface is also provided; it may have a threaded free end so that an extension handle may be attached thereto. The frame means further includes a rigid clip rod disposed parallel to the first and second axle means; it is positioned between the first and second axle means. A clip means is pivotally secured to a distal end of the elongate handle so that the handle and clip means are pivotally connected to one another for movement in a first plane. The clip means is adpated to pivotally engage the rigid clip rod so that the handle and frame means are pivotal with respect to one another in a second plane that is normal to the first plane. A locking means is slideably mounted on the elongate handle and has an extended position where it prevents pivoting of the clip means and the handle in the first plane.

It is a primary object of this invention to provide a paint roller construction that can be controlled with precision in various hard-to-reach areas of a paintable surface.

Another object is to attain the foregoing object in a simple yet elegant construction that can be economically manufactured.

A more specific object is to provide a paint roller construction where the paint rollers are pivotally attached to an elongate handle with two degrees of freedom.

Another specific object is to provide such a construction where a locking means is provided to remove one of the degrees of freedom when desired.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
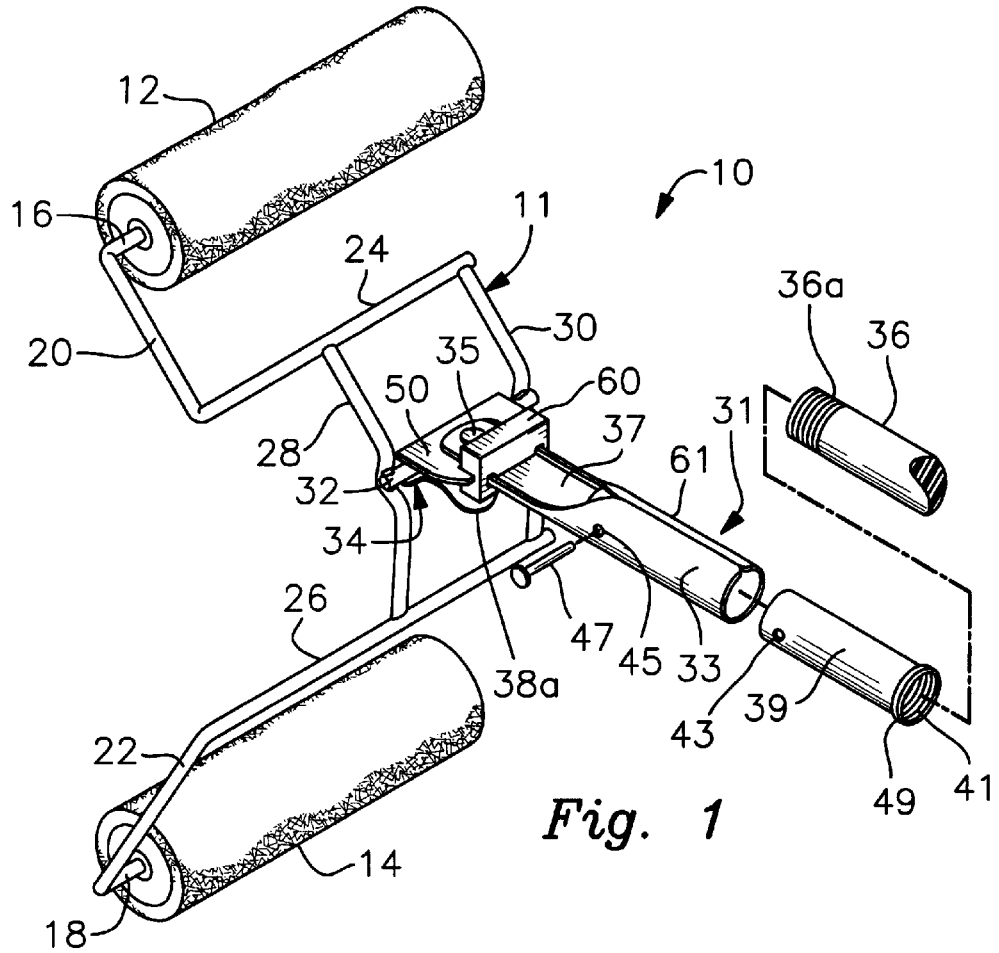
FIG. 1 is a perspective view of a pair of paint rollers and a frame upon which they are mounted.

Referring now to FIG. 1, it will there be seen that an exemplary embodiment of the invention is denoted as a whole by the reference numeral 10.

Paint roller assembly 10 includes a rigid frame means 11. A pair of paint rollers 12, 14 are mounted for rotation about axles 16, 18, respectively, in the well-known way. A first ninety degree bend is formed in each respective axle to form a spacer rod 20, 22 and a second ninety degree bend is formed in each respective axle to form a mounting rod 24, 26. Mounting rods 24, 26 are rigidly interconnected to one another by parallel interconnecting rods 28, 30, and interconnecting rods 28, 30 are interconnected to one another at their respective mid-lengths by rigid clip rod 32. Thus, frame means 11 is collectively formed by axles 16, 18, spacer rods 28, 30, and clip rod 32.

Clip rod 32 is gripped by a clip means generally denoted 34. A socket member 31, preferably metallic, has a cylindrical main body part 33 and a flat leading end 37. A preferably plastic tube 39 having internal threads 41 formed in its trailing end is slideably received within main body part 33. A throughbore 43 formed in a leading end of tube 39 aligns with a throughbore 45 formed in the leading end of main body 33 when said tube is inserted within said main body. A retainer pin 47 extends diametrically through said throughbores to lock tube 39 into cylindrical main body 33 and suitable means are employed to prevent unwanted retraction of said retainer pin. Rim 49 at the trailing end of tube 39 limits the insertion of said tube into said main body.

An elongate handle means 36 is externally threaded at its leading end as at 36*a* and is therefore screw-threadedly engageable with internal threads 41. External threads 36*b* (FIG. 2) may be formed on the trailing end of handle means 36 to enable screw-threaded connection thereto of a suitable handle extension means.

Pivot pin 35 provides pivotal interconnection between clip means 34 and flat leading end 37 of metallic socket member 31. In this way, elongate handle 36 is pivotally interconnected to clip means 34. This enables pivotal movement of frame means 11 relative to the longitudinal axis of handle 36 in a first plane. There are numerous other equivalent mechanical means for pivotally interconnecting elongate handle 36 to clip means 34, and all of said equivalent means are within the scope of this invention.

Figure 2:
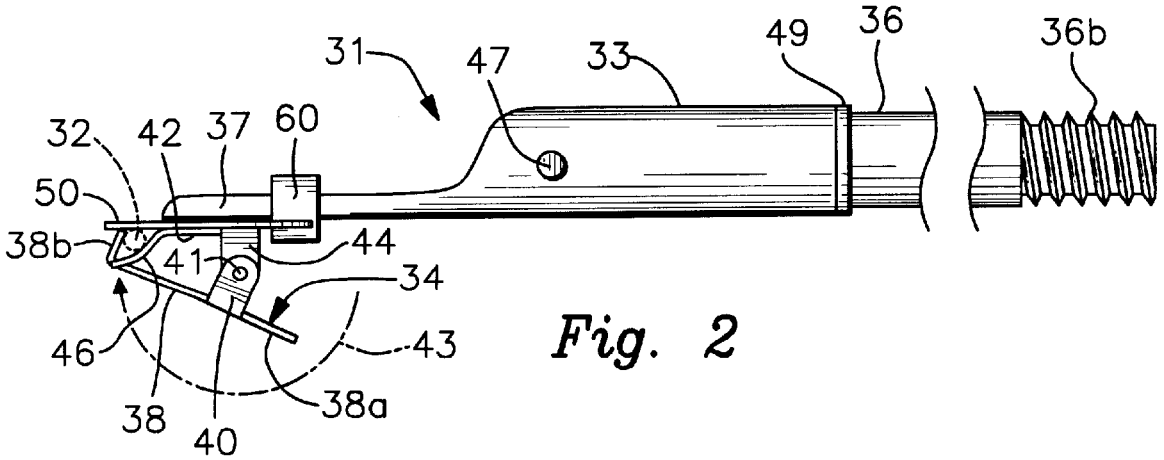
FIG. 2 is a side elevational view of the distal end of the novel handle, depicting a clip means for detachably engaging the handle to the frame depicted in FIG. 1.

As perhaps best understood in connection with FIG. 2, clip means 34 is spring-biased and has a position of repose as depicted in said FIG. 2; note that rigid clip rod 32 is captured by clip means 34. This is the relationship between clip rod 32 and clip means 34 that is depicted in FIG. 1.

Clip means 34 has two primary parts, i.e., an "L"-shaped base 38 having a pair of transversely spaced apart apertured lugs 40, only one of which is visible in the side view of FIG. 2, and a top part 42 having a matching pair of apertured depending lugs 44. Lugs 40, 44 are pivotally attached to one another about lug axle 41.

Top part 42 further includes a leading end 46 that is bent toward base 38 and which underlies clip 32 when said clip rod is captured by clip means 34. Truncate part 38*b* of "L"-shaped base 38 cooperates with underlying part 46 to capture said clip rod 32 as is clear from FIG. 2. Directional arrow 43 indicates the direction of bias, i.e., a spring, not shown, having one end thereof secured to lug axle 41, urges base 38 of clip means 34 to rotate about said exle to trap clip rod 32 in the manner described above. Clip rod 32 is of cylindrical construction so the respective leading ends of clip means 34 are rotatable about the longitudinal axis of the clip rod when said clip rod is captured between them.

Figure 3:
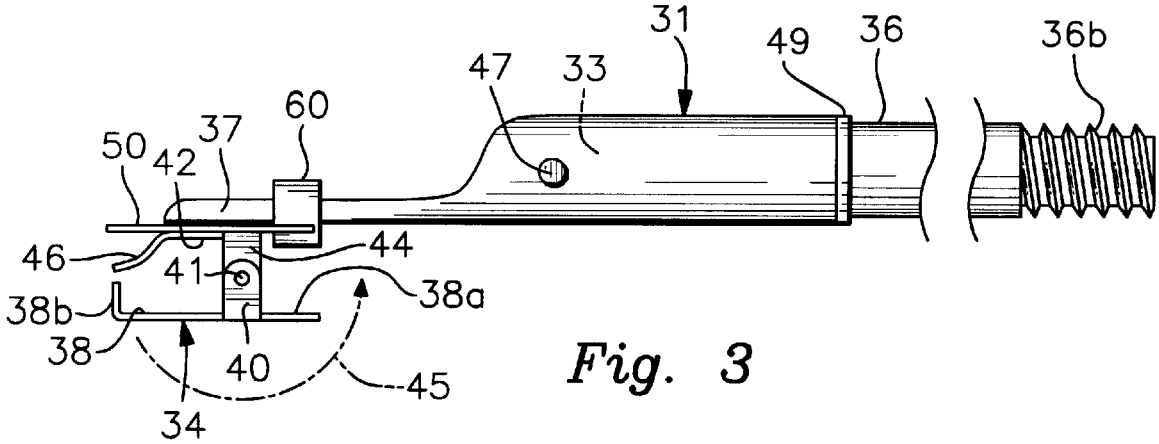
FIG. 3 is a side elevational view like FIG. 2, but showing the clip means of FIG. 2 in its frame-engaging position of repose.

As should be clear from a comparison of FIGS. 2 and 3, pressing against trailing end 38*a* of base 38 rotates said base 38 in the direction of directional arrow 45 (FIG. 3), against the bias of the above-mentioned spring; it follows that the position of FIG. 3 is not the repose position of clip means 34. When base 38 is substantially parallel to top part 42 of clip means 34, clip rod 32 is easily removable from its captured position.

A first surface of flat interconnecting plate 50 overlies top part 42 of clip means 34 and is fixedly secured thereto. Pivot pin 35 interconnects flat leading end 37 of handle-receiving socket 31 and plate 50.

A locking block 60 is slideably mounted to flat distal end 37 of socket 31. Said locking block 60 is in its extended or locking position in FIG. 2.

Figure 4:
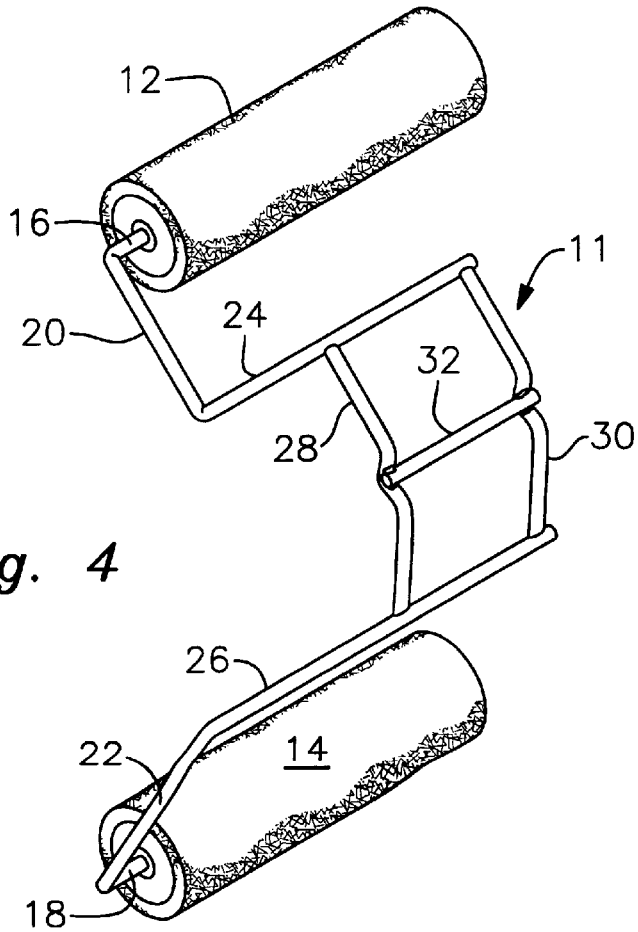
FIG. 4 is a perspective view of the paint rollers and frame when said frame is engaged by the clip means.

FIG. 4 depicts the frame assembly for holding rollers 12, 14 when said frame assembly is detached from clip means 34, i.e., when clip rod 32 is not engaged by clip means 34.

Figure 5:
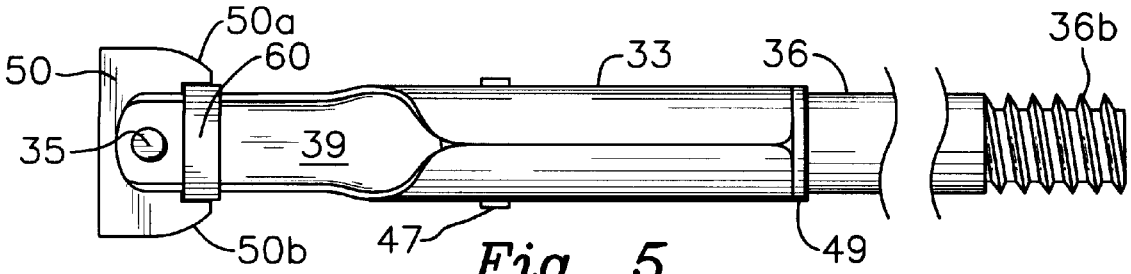
FIG. 5 is a top plan view of the handle and clip means when a novel locking means is advanced into a locking configuration to prevent pivotal movement of the handle with respect to the clip means in a first plane.
Figure 6:
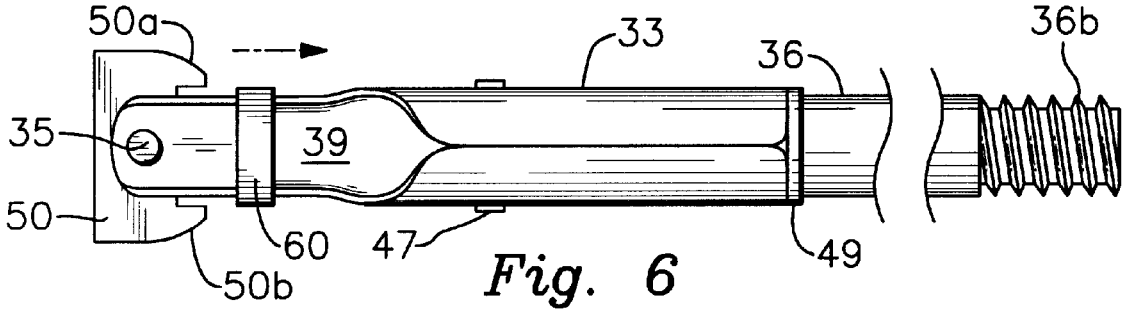
FIG. 6 is a top plan view like FIG. 5, but depicting the locking means when retracted to allow pivotal movement of said handle with respect to said clip means in said first plane.
Figure 7:
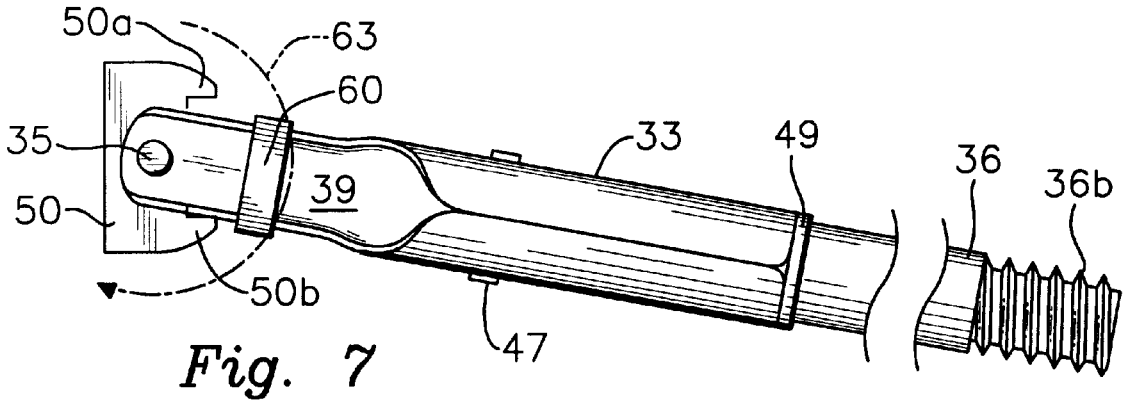
FIG. 7 is a top plan view like FIG. 6, depicting the handle in a first pivotal position with respect to said clip means in said first plane.
Figure 8:
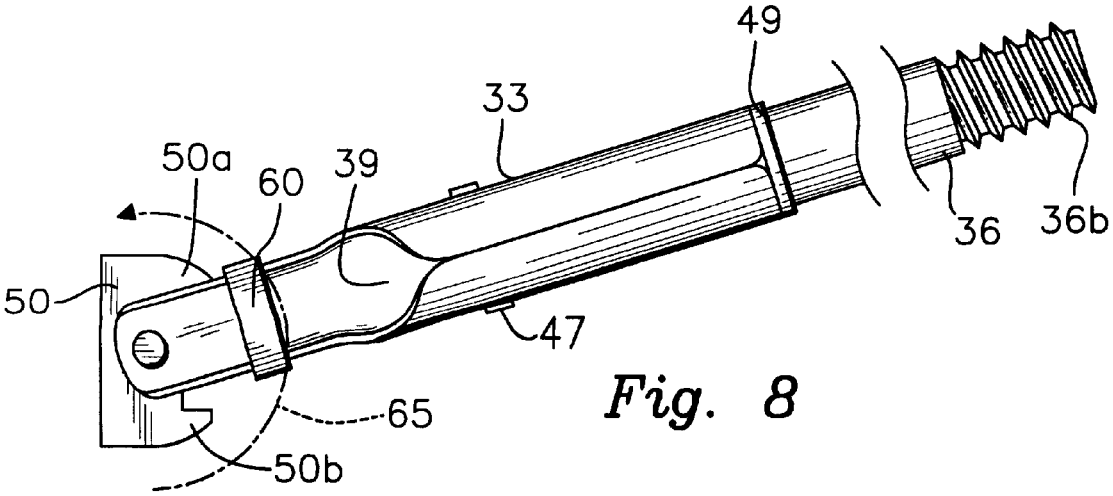
FIG. 8 is a top plan view like FIG. 6, depicting the handle in a second pivotal position with respect to said clip means in said first plane.

FIGS. 5–8 better illustrate how locking block 60 performs its function. When fully extended, i.e., when in its forward-most position, as depicted in FIGS. 1–3 and FIG. 5, it prevents pivoting of handle 36 in a first plane. As drawn, the first plane is in the plane of the paper. Pivot pin 35 provides a pivotal connection between handle 36 and clip means 34 as mentioned above, but when said locking block 60 is fully advanced as depicted in FIG. 5, it blocks pivotal motion of handle 36 in said plane with respect to clip means 34 as just mentioned. However, when retracted in the direction of arrow 61, locking block 60 no longer interferes with such pivotal motion and such pivotal motion, as indicated in FIGS. 7 and 8 by arrows 63 and 65, respectively, is freely available. This is the first degree of freedom between frame 11 and handle 36.

More particularly, top plate 50 of clip means 34 has a pair of parallel or transversly spaced apart, longitudinally extending tabs 50*a*, 50*b* that extend an equal extent in a common trailing direction. The innermost edges of said tabs are spaced apart from one another by a distance greater than the diameter of socket 31 so that a gap is provided between said respective innermost edges and the peripheral boundary of flat leading end 37 of socket 31. That gap is occupied by locking block 60 when said locking block is in its extended position as depicted in FIG. 5 and said gap is unoccupied by said locking block when in its retracted position as depicted in FIGS. 6–8. Thus, to lock handle 36 into non-pivoting relation to clip means 34 in the plane of the paper, i.e., to prevent pivotal movement in said first plane as depicted in FIGS. 7 and 8, locking block 60 is simply slid from its FIG. 6 position to its FIG. 5 position.

However, when so locked against pivotal movement in said first plane, pivotal movement between clip means 34 and handle 36 in a second plane is still available. The second plane is normal to the first, i.e., it is normal to the plane of the paper relative to FIGS. 5–8 and is in the plane of the paper relative to FIGS. 2 and 3; this is the second degree of freedom.

When it is desired to apply paint to a preselected surface with up and down strokes, locking block 60 is advanced as depicted in FIGS. 1–3 and 5. As perhaps best understood in connection with FIG. 1, this prevents unwanted sideways movement of rollers 12, 14 with respect to handle 36 while allowing free pivotal motion in the above-defined second plane. It should be clear that one can apply paint equally well in left-to-right strokes when the apparatus is configured as in FIG. 1, and in any other direction between up-and-down and left-to-right when said locking block is fully extended. The only restriction is that the longitudinal axis of handle 36 remains at a ninety degree angle with respect to the respective longitudinal axes of paint roller axes 16, 18 and clip rod 32. When locking block 60 is retracted, that restriction is removed and the second degree of freedom is available, i.e., the angle between the longitudinal axis of handle 36 and the respective longitudinal axes of paint roller axes 16, 18 and clip rod 32 may vary in the manner depicted in FIGS. 7 and 8. This facilitates the application of paint with the novel paint roller assembly even if the painter is not positioned directly behind the paint rollers.

Importantly, whether locking block 60 is extended or retracted, clip means 34 prevents rotation of rollers 12, 14 about the longitudinal axis of handle 36. In this way, the instantaneous position of the rollers is always under the direct control of the painter.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device for applying paint to a preselected surface, comprising:

a frame means including a first and second axle means;

each of said first and second axle means adapted to rotatably mount a paint roller thereon;

said first and second axle means being disposed in spaced apart, parallel relation to one another;

an elongate handle means adapted to be grasped by an individual when applying paint to said preselected surface;

said frame means further including a rigid clip rod disposed parallel to said first and second axle means and positioned between said first and second axle means;

a clip means pivotally secured to a distal end of said elongate handle means so that said elongate handle means and clip means are pivotally connected to one another for movement in a first plane;

said clip means adapted to pivotally engage said rigid clip rod so that said elongate handle means and frame means are pivotal with respect to one another in a second plane that is normal to said first plane; and a locking means slideably mounted on said elongate handle and having an extended position where it prevents pivoting of said clip means and said elongate handle means in said first plane.

2. The device of claim 1, wherein said clip means includes a top part and a bottom part that are pivotally connected to one another, said top and bottom part having respective leading ends that are biased toward one another, said bottom part and said top part being specifically configured to capture said rigid clip rod when said clip means is in a position of repose, and said rigid clip rod and hence said frame means being separable from said clip means when said respective leading ends of said top and bottom parts are spaced apart from one another when said bias is overcome.

3. The device of claim 2, wherein said rigid clip rod has a cylindrical configuration so that said respective leading ends of said clip means are rotatable about a longitudinal axis of said rigid clip rod when said rigid clip rod is captured between said respective leading ends of said clip means, said rotatable movement of said clip means about said longitudinal axis being said movement in said second plane.

4. The device of claim 1, further comprising a handle-receiving socket means having a cylindrical main body part for slideably receiving a leading end of said elongate handle means, said socket means having a flat leading end, wherein said clip means is pivotally secured to said flat leading end, and wherein said locking means is slideably mounted on said flat leading end between a retracted position and said extended position, said locking means being disposed out of locking relation to said clip means when in said retracted position.

5. The device of claim 1, further comprising screw threads formed on a trailing end of said elongate handle to enable attachment thereto of an extension handle.

* * * * *